US007182176B2

(12) United States Patent
Gibson et al.

(10) Patent No.: US 7,182,176 B2
(45) Date of Patent: Feb. 27, 2007

(54) STEP STOOL WITH ELEVATED TRAY

(75) Inventors: William R. Gibson, Kent, OH (US); Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 249 days.

(21) Appl. No.: 10/857,331

(22) Filed: May 28, 2004

(65) Prior Publication Data

US 2005/0284701 A1 Dec. 29, 2005

(51) Int. Cl.
*E06C 1/00* (2006.01)

(52) U.S. Cl. ..... 182/129; 182/165; 182/129; 182/162; 182/180.1

(58) Field of Classification Search ..... 182/129, 182/21, 22, 23, 33.3, 196, 165, 180.1, 161, 182/162
See application file for complete search history.

(56) References Cited

U.S. PATENT DOCUMENTS

D388,882 S * 1/1998 Kain ..... D25/64
5,722,507 A 3/1998 Kain
5,762,163 A * 6/1998 Kain ..... 182/161
6,000,497 A * 12/1999 Kain et al. ..... 182/129
D433,156 S * 10/2000 Gibson et al. ..... D25/64
D444,574 S * 7/2001 Gibson et al. ..... D25/65
6,390,238 B1 5/2002 Gibson et al.
6,427,805 B1 8/2002 Gibson et al.
6,443,261 B1 * 9/2002 Gibson et al. ..... 182/161
D465,289 S 11/2002 Gibson et al.
6,536,557 B2 * 3/2003 Gibson et al. ..... 182/161
6,550,579 B2 * 4/2003 Gibson et al. ..... 182/161
2002/0017430 A1 2/2002 Rosko
2002/0017431 A1 * 2/2002 Gibson et al. ..... 182/161

* cited by examiner

*Primary Examiner*—Peter M. Cuomo
*Assistant Examiner*—Lindsay M. Maguire
(74) *Attorney, Agent, or Firm*—Barnes & Thornburg LLP

(57) ABSTRACT

A foldable step stool includes pivotable front and rear leg units and steps coupled to the front leg unit. A utility tray pivots relative to the front leg unit.

15 Claims, 8 Drawing Sheets

STEP STOOL WITH ELEVATED TRAY

BACKGROUND

The present disclosure relates to a step stool, and particularly to a foldable step stool having leg units that move relative to one another between an opened use position and a closed storage position. More particularly, the present disclosure relates to a foldable step stool including a pivotable utility tray.

SUMMARY

In accordance with the present disclosure, a utility tray rests on, is secured to, and pivots on a top cross member connecting left and right front legs of a step stool frame. A tray pivot controller is coupled to a pivot point provided on the tray and to another pivot point provided on a top step mounted for pivotable movement on the left and right front legs. The tray folds automatically from an extended position to a retracted position whenever left and right rear legs included in the step stool frame are pivoted relative to the left and right front legs from an opened position to a closed position.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

In accordance with the present disclosure, a first step stool 10 is shown in FIGS. 1–6 and a second step stool 110 is shown in FIGS. 7–13. In each embodiment, a utility tray is mounted to pivot on a top cross member of a front leg unit in a manner controlled by a tray pivot controller coupled to the tray and to a top step coupled to pivot on the front leg unit.

Figure 1:
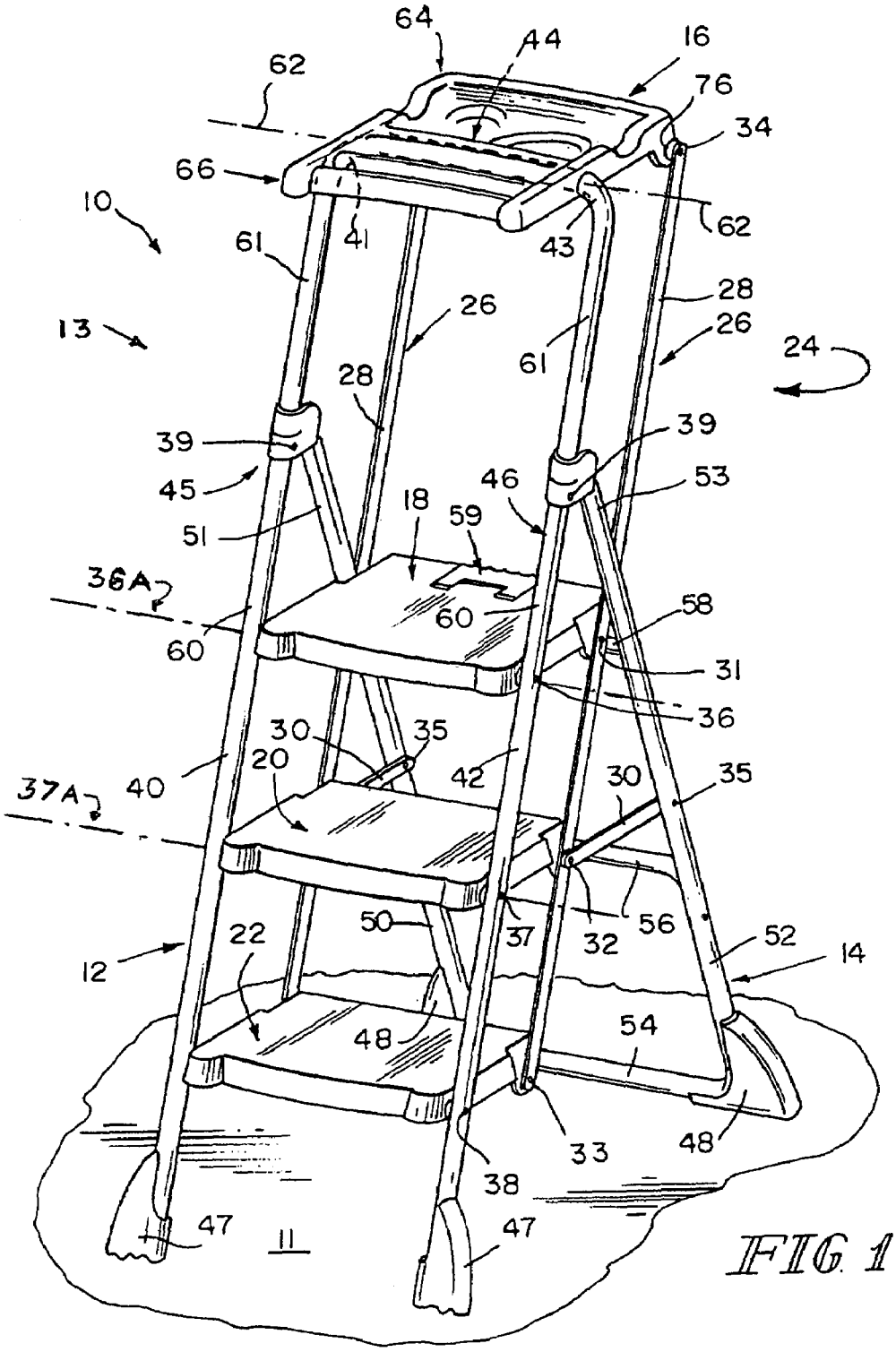
FIG. 1 is a perspective view showing a step stool having front and rear leg units arranged in an opened position and showing a tray pivotably coupled to a top end of the front leg unit and a tray pivot controller comprising a longer link pivotably coupled to the steps and the tray and a shorter link pivotably coupled to the longer link and the rear leg unit.
Figure 2:
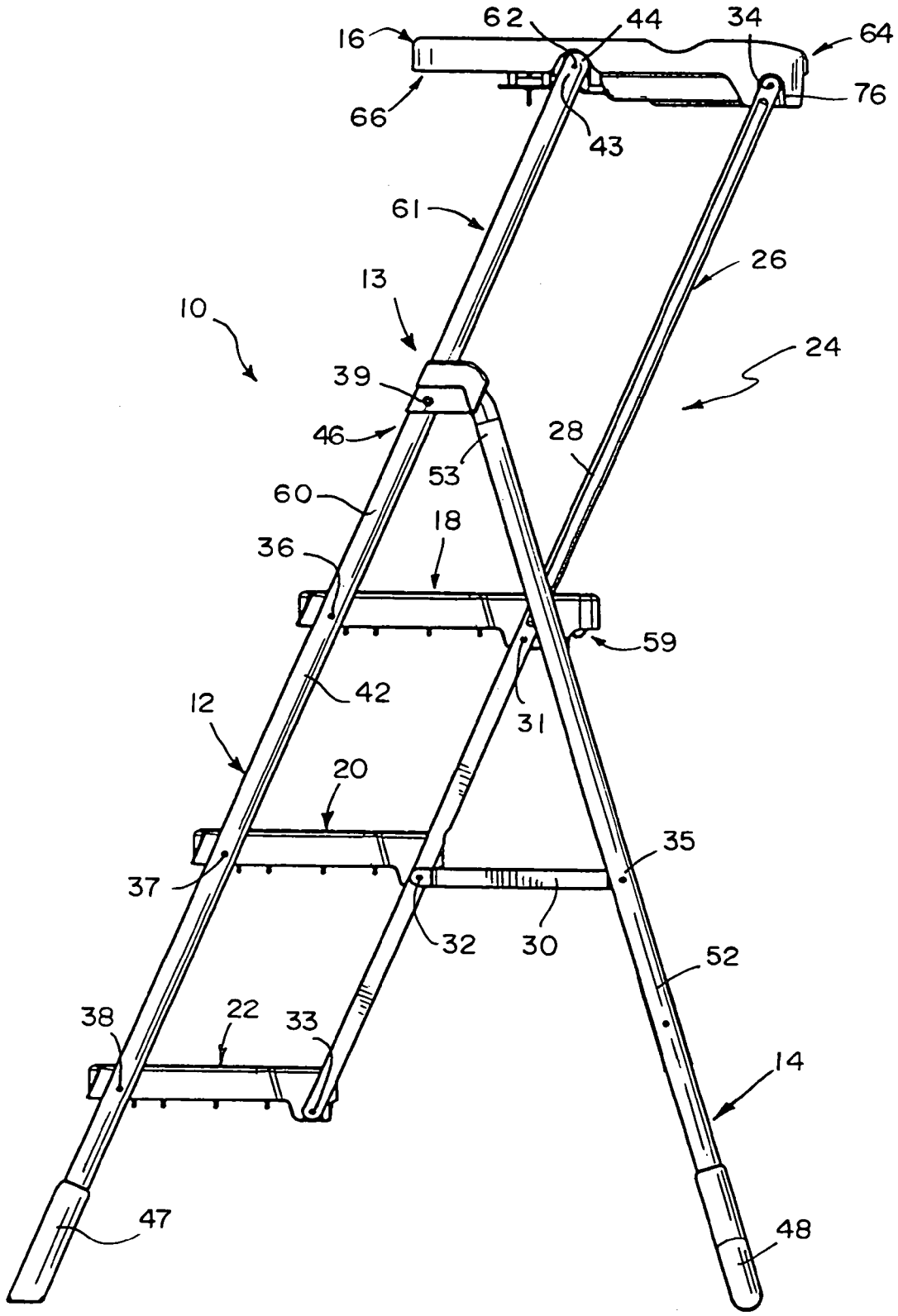
FIG. 2 is a side elevation view showing the step stool of FIG. 1 in the opened position.

Step stool 10 includes a front leg unit 12, rear leg unit 14, utility tray 16, top step 18, and second and third steps 20, 22 as shown, for example, in FIGS. 1 and 2. Step stool 10 also includes a tray pivot controller 24 comprising a pair of control linkages 26 and each control linkage 26 comprises a tray-mover link 28 and a step-folder link 30.

In the illustrated embodiment, each tray-mover link 28 is coupled to steps 18, 20, 22, respectively, at pivot points 31, 32, 33 and to tray 16 at pivot point 34. Also, each step-folder link 30 is coupled to second step 20 at pivot point 32 and to rear leg unit 14 at pivot point 35. Steps 18, 20, 22 are coupled to front leg unit 12, respectively, at pivot points 36, 37, 38. Rear leg unit 14 is coupled to front leg unit 12 at leg pivot point 39.

Front and rear leg units 12, 14 cooperate to define a foldable frame 13 that is configured to support tray 16 and steps 18, 20, 22 as frame 13 is folded and unfolded. Rear leg unit 14 is coupled to front leg unit 12 for pivotable movement at leg pivot points 39 between an unfolded, opened position shown, for example, in FIGS. 1 and 2 and a folded, closed position shown, for example, in FIG. 4.

Figure 5:
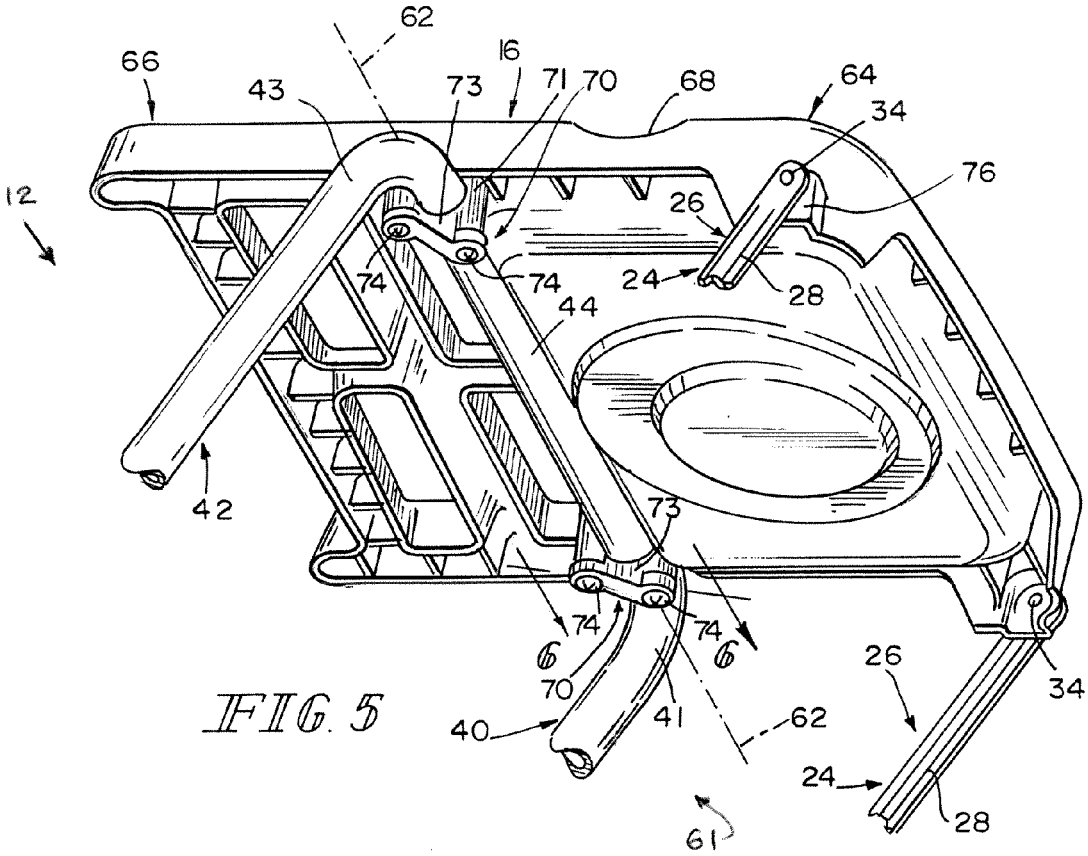
FIG. 5 is a perspective view, with portions broken away, showing the tray of FIG. 1 supported in a use position by the tray pivot controller and coupled to a cross member included in the front leg unit for pivotable movement about a horizontal pivot axis to the stored position shown, for example, in FIG. 4.

As suggested in FIGS. 1 and 5, front leg unit 12 comprises a left leg 40 having an upper end 41, a right leg 42 having an upper end 43, and a top cross member 44. Right leg 42 is arranged to lie in spaced-apart relation to left leg 40. Top cross member 44 interconnects upper ends 41, 43 of left and right legs 40, 42 as shown, for example, in FIG. 5. Each of left and right legs 40, 42 includes a lower end adapted to contact ground 11 underlying frame 13 and a mid-section 45 or 46 located between lower and upper ends thereof. In the illustrated embodiment, feet 47 are mounted on the lower ends of each of left and right legs 40, 42. In the illustrated embodiment, front leg unit is U-shaped as suggested in FIGS. 1 and 5.

As suggested in FIG. 1, rear leg unit 14 comprises a left leg 50 having an upper end 51, a right leg 52 having an upper end 53, a bottom cross member 54 interconnecting lower ends of left and right legs 50, 52, a middle cross member 56 interconnecting middle portions of left and right legs 50, 52, and a step-support cross member 58 interconnecting upper portions of left and right legs 50, 52. In the illustrated embodiment, feet 48 are mounted on bottom cross member 54 and lower ends of left and right legs 50, 52 as suggested in FIGS. 1 and 2.

Upper ends 51, 53 of left and right legs 50, 52 are coupled, respectively, to mid-sections 45, 46 of left and right legs 40, 42 of front leg unit 12 at pivot points 39 so that rear leg unit 14 is able to pivot relative to front leg unit 12 about a leg pivot axis extending through pivot points 39. Thus, rear leg unit 14 can pivot about that leg pivot axis 39 between an opened position away from left and right legs 40, 42 as shown, for example, in FIGS. 1 and 2 and a closed position alongside left and right legs 40, 42 as shown, for example, in FIG. 4. As shown in FIGS. 1 and 2, leg pivot points 39 are located above top step pivot points 36 and below top cross member 44.

In the opened position, a lock mechanism 59 provided on top step 18 mates with step-support cross member 58 to retain top step 18 in mating engagement with rear leg unit 14. Reference is made to U.S. Pat. No. 6,427,805, which patent is hereby incorporated by reference herein, for a description of a suitable lock mechanism.

Front leg unit 12 includes a lower section 60 (comprising lower portions of left and right legs 40, 42) and an upper section 61 (comprising upper portions of left and right legs 40, 42) as suggested in FIGS. 1 and 2. Lower section 60 is arranged to extend downwardly from leg pivot axis 39 and adapted to contact ground 11 underlying frame 13. Upper section 61 extends upwardly away from lower section 60. Steps 18, 20, 22 are coupled to lower section 60.

Utility tray 16 is mounted on a distal portion of upper section 61 of front leg unit 12 for pivotable movement about a tray pivot axis 62 as suggested in FIGS. 1, 3, 5, and 6. In the illustrated embodiment, top cross member 44 is configured to define that distal portion of upper section 61.

Tray pivot controller 24 is configured to control pivoting movement of tray 16 relative to front leg unit 12 about tray pivot axis 62 automatically during folding and unfolding of step stool 10. Each tray-mover link 28 is pivotably coupled to tray 16 at an upper link pivot axis intersecting pivot points 34 and to top step 18 at a first lower link pivot axis intersecting pivot points 31. Tray-mover links 28 are configured to maintain tray 16 in substantially parallel relation to top step 18 during movement of rear leg unit 14 between the opened and closed positions as suggested in FIGS. 2 and 3.

As suggested in FIG. 2, tray 16 includes a shelf portion 64 and an overhang portion 66. Shelf portion 64 is pivotably coupled to top cross member 44 and to each tray-mover link 28. Top cross member 44 of U-shaped front leg unit 12 is arranged to lie above leg pivot axis 39 and below upper link pivot axis 34 upon movement of rear leg unit 12 to the closed position.

Figure 3:
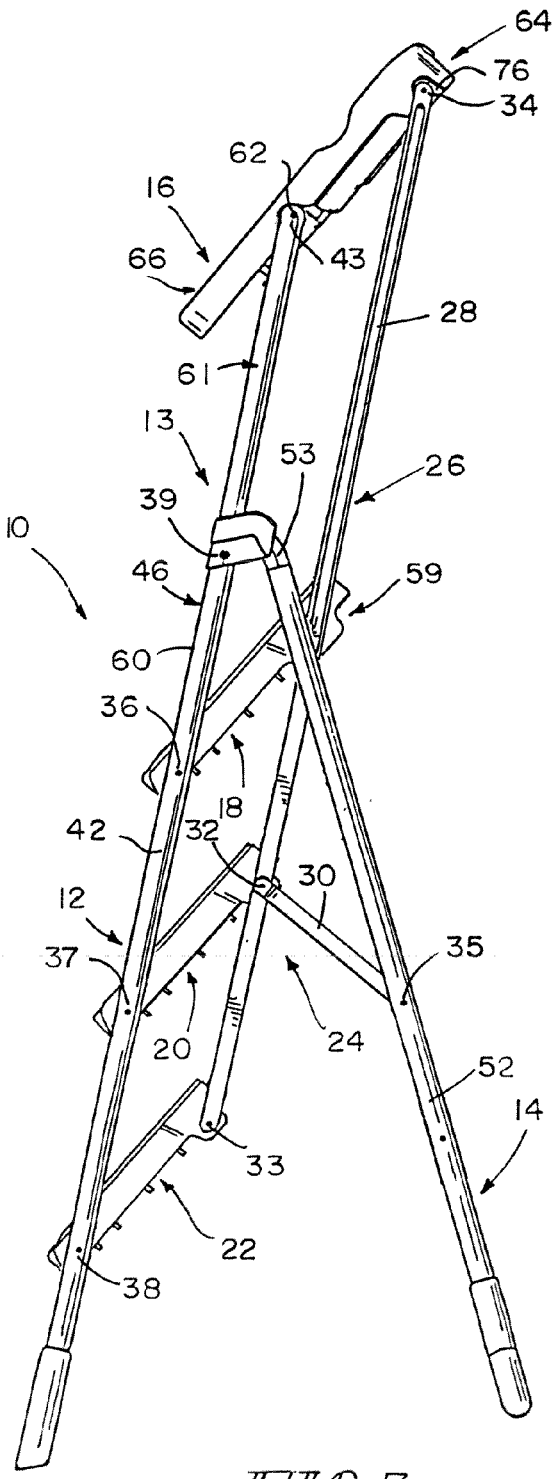
FIG. 3 is a side elevation view showing the step stool of FIG. 1 in a partly closed position and showing pivoting movement of the tray about the top end of the front leg unit in response to movement of the tray pivot controller during pivoting movement of the rear leg unit toward the front leg unit.

Shelf portion 64 of tray 16 is arranged to extend in a first direction from tray pivot axis 62 toward upper link pivot axis 34 and remain in substantially parallel relation to top step 18 during movement of rear leg unit 14 between the opened and closed positions. In the illustrated embodiment, as shown in FIGS. 2 and 3, shelf portion 64 of tray 16, a portion of tray-mover link 28 extending between pivot points 31, 34, top step 18, and upper section 61 of right leg 42 of front leg unit 12 cooperate to define a parallelogram-shaped linkage having pivoting joints at the "intersection" of each "link" in the linkage.

Overhang portion 66 of tray 16 is arranged to extend away from shelf portion 64 in a second direction opposite to the first direction to overlie leg pivot axis 39 as suggested, for example, in FIG. 2. Overhang portion 66 is arranged to extend along and in side-by-side relation to left and right legs 40, 42 of U-shaped front leg unit 12 upon movement of rear leg unit 14 to the closed position as suggested in FIG. 4.

Figure 6:
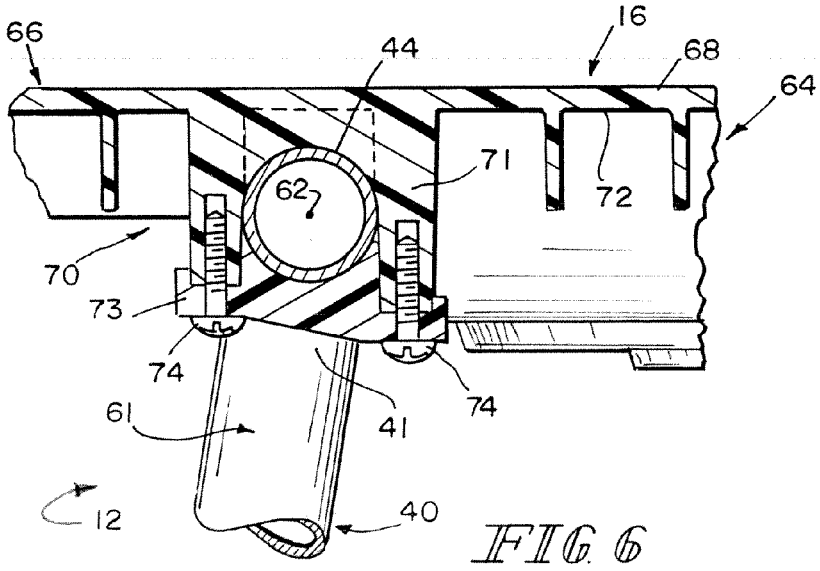
FIG. 6 is a sectional view taken along lines 6—6 of FIG. 5.

As suggested in FIGS. 5 and 6, shelf portion 64 includes a top shelf surface 68 and a pair of tray retainers 70 coupled to top cross member 44. Tray retainers 70 cooperate to define means for supporting tray 16 for rotation about tray pivot axis 62 during folding and unfolding of step stool 10.

Each tray retainer 70 includes a fixed portion 71 coupled to an underside 72 of top shelf surface 68 and arranged to engage top cross member 44. Each tray retainer 70 also includes a movable clamp portion 73 arranged to engage top cross member 44 in the illustrated embodiment. Fasteners 74 are included in each tray retainer 70 and arranged to retain clamp portion 73 in a selected position relative to a companion fixed portion to allow rotary movement of top cross member 44 in a space between fixed and clamp portions during pivoting movement of tray 16 relative to front leg unit 12 about tray pivot axis 62.

Figure 4:
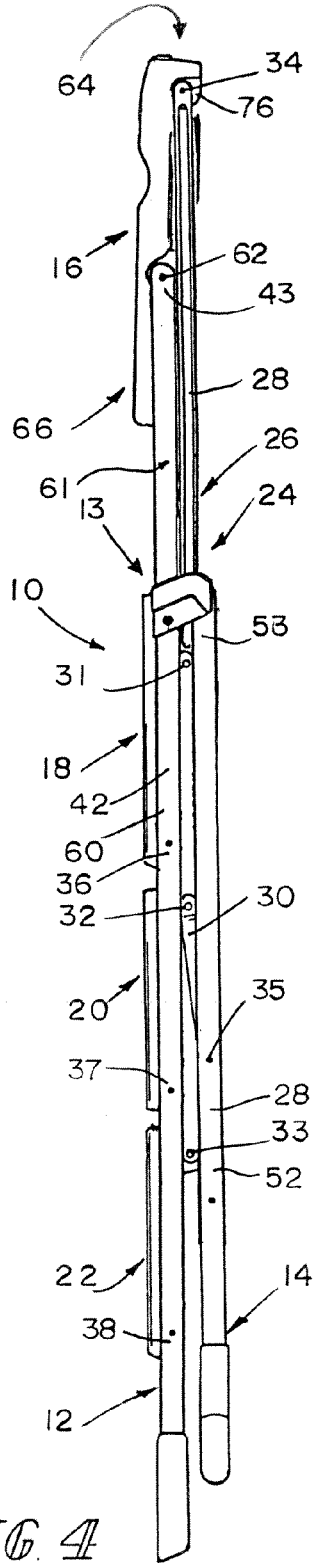
FIG. 4 is a side elevation view showing the step stool of FIG. 1 in a closed position and the tray in a stored position.

Shelf portion 64 further includes a pair of pivot mounts 76 located below top shelf surface 68 as shown, for example, in FIGS. 1 and 5. Each pivot mount 76 is pivotably coupled to a companion tray-mover link 28 at upper link pivot axis 34 as shown best in FIG. 5. As shown in FIG. 4, pivot mount 76 is arranged to lie in spaced-apart relation to leg pivot axis 39 to locate top cross member 44 of U-shaped front leg unit 12 therebetween upon movement of rear leg unit 14 to the closed position.

Second step 20 is arranged to lie under top step 18 and between left and right legs 40, 42 of front leg unit 12 as suggested in FIG. 1. Top step 18 pivots about axis 36A. Second step 20 is coupled to mid-sections 45, 46 of left and right legs 40, 42 at second step pivot points 37 on each of left and right legs 40, 42 for pivotable movement about second step pivot axis 37A. Each tray-mover link 28 is also pivotably coupled to second step 20 at second lower link pivot axis 32.

Third step 22 is arranged to lie under second step 20 and between left and right legs 40, 42 of front leg unit 12 as suggested in FIG. 1. Third step 22 is coupled to mid-sections 45, 46 of left and right legs 40, 42 at third step pivot points 38 on each of left and right legs 40, 42 for pivotable movement about third step pivot axis 38. Each tray-mover link 28 is also pivotably coupled to third step 22 at third lower link pivot axis 33.

Tray pivot controller 24 is coupled to top step 18, rear leg unit 14, and tray 16 to cause pivotable movement between front and rear leg units 12, 14 and pivotable movement of tray 16 on top cross member 44 upon pivotable movement of top step 18 relative to legs 40, 42 of front leg unit 12 as suggested in FIGS. 2-4. Each linkage 26 in tray pivot controller 24 includes tray-mover link 28 and step-folder link 30. In the illustrated embodiment, each tray-mover link 28 is a straight, elongated member that is arranged to lie in and remain in parallel relation to a companion one of the left and right legs 40, 42 of front leg unit 12 during movement of rear leg unit 14 between the opened and closed positions.

Figure 7:
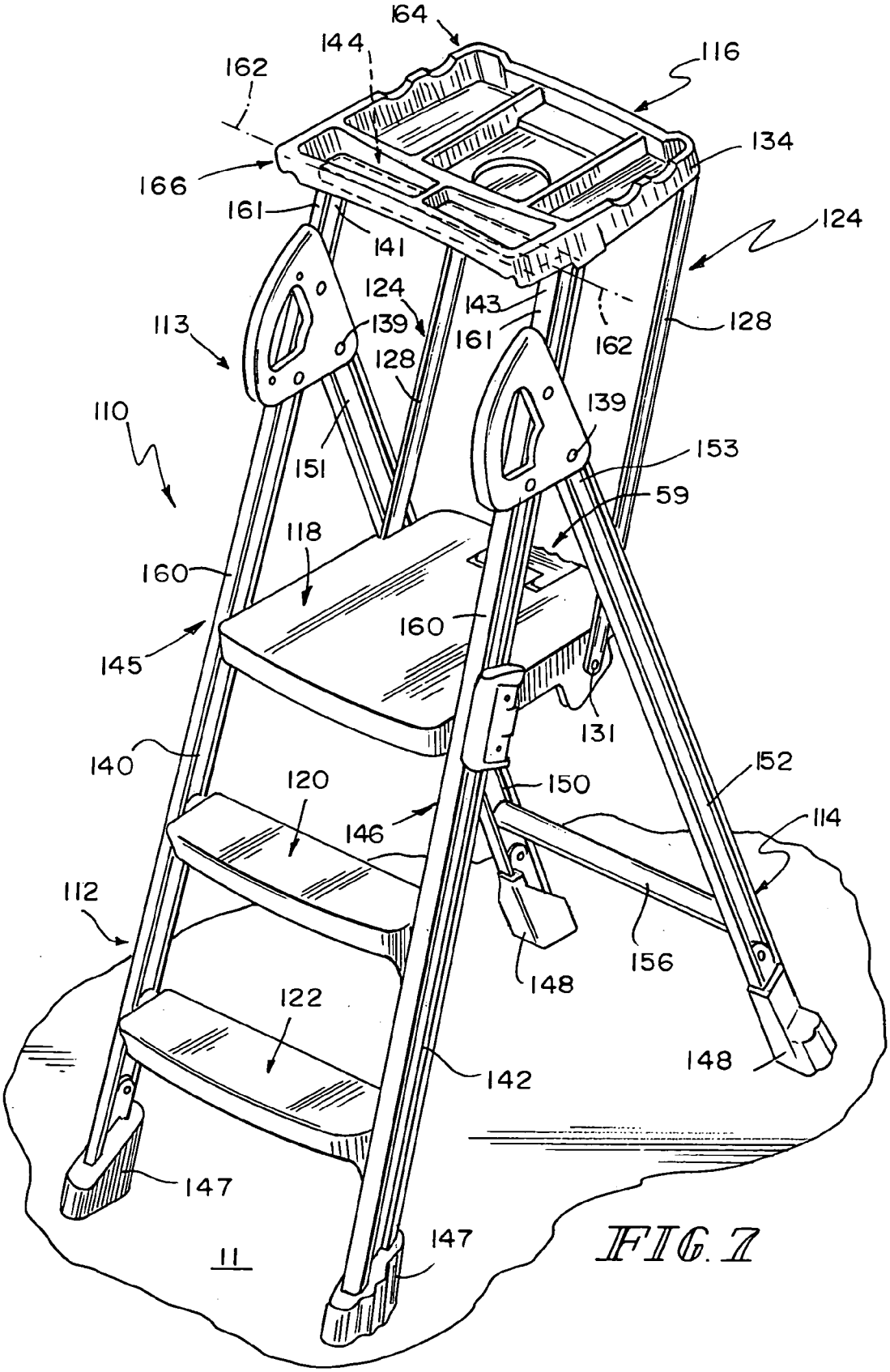
FIG. 7 is a perspective view showing a second step stool having front and rear leg units arranged in an opened position and showing a tray pivotably coupled to a top end of the front leg unit and a tray pivot controller comprising a link pivotably coupled to the top step and the tray.
Figure 8:
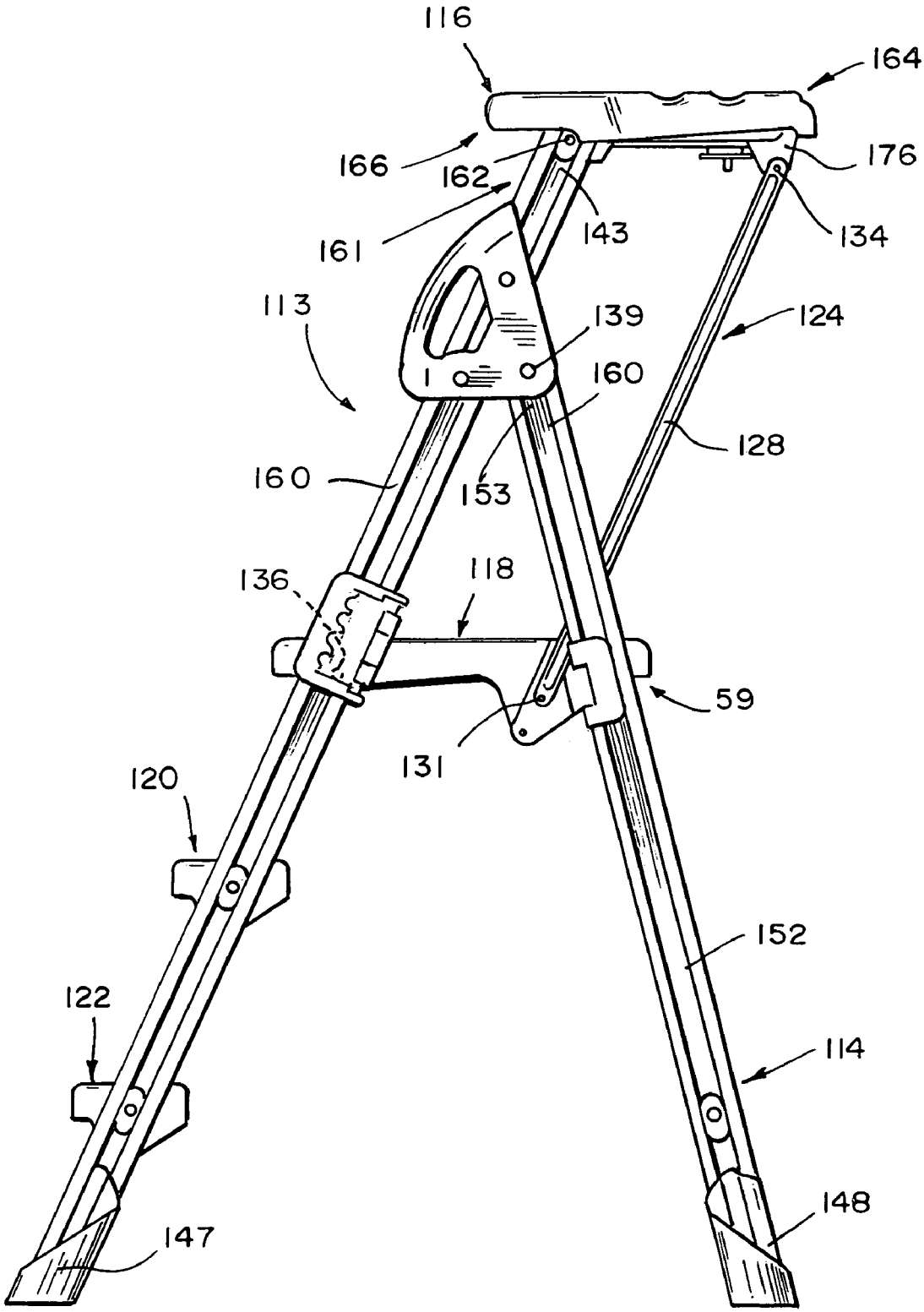
FIG. 8 is a side elevation view showing the step stool of FIG. 7 in the opened position.

In accordance with a second embodiment of this disclosure, step stool 110 includes a front leg unit 112, rear leg unit 114, utility tray 116, top step 118, and second and third steps 120, 122 as shown, for example, in FIGS. 7 and 8. Step stool 110 also includes a tray pivot controller 124 comprising a pair of control linkages and each control linkage comprises a tray-mover link 128 shown, for example, in FIG. 7 and a step-folder link 130 shown, for example, in FIG. 11.

Figure 11:
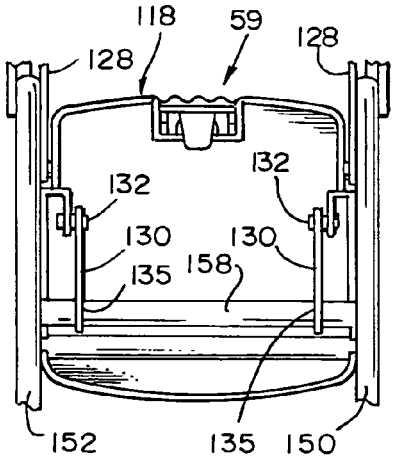
FIG. 11 is a rear elevation view of the closed step stool of FIG. 10, with portions broken away, showing a pair of shorter links included in the tray pivot controller of FIG. 7 and coupled to a cross member included in the rear leg unit and to spaced-apart link mounts included in the top step.

In the illustrated embodiment, each tray-mover link 128 is coupled to steps 118 at pivot points 131 and to tray 116 at pivot point 134. Also, as shown in FIG. 11, each step-folder link 130 is coupled at one end to top step 118 at pivot point 132 and at an opposite end to a step-support cross member 158 interconnecting left and right legs 150, 152 of rear leg unit 114 at pivot points 135. Step 118 is coupled to front leg unit 112 at pivot points 136. Rear leg unit 14 is coupled to front leg unit 12 at leg pivot points 139.

Front and rear leg units 112, 114 cooperate to define a foldable frame 113 that is configured to support tray 116 and steps 118, 120, 122 as frame 113 is folded and unfolded. Rear leg unit 114 is coupled to front leg unit 112 for pivotable movement at leg pivot points 139 between an unfolded, opened position shown, for example, in FIGS. 7 and 8 and a folded, closed position shown, for example, in FIG. 10.

Figure 12:
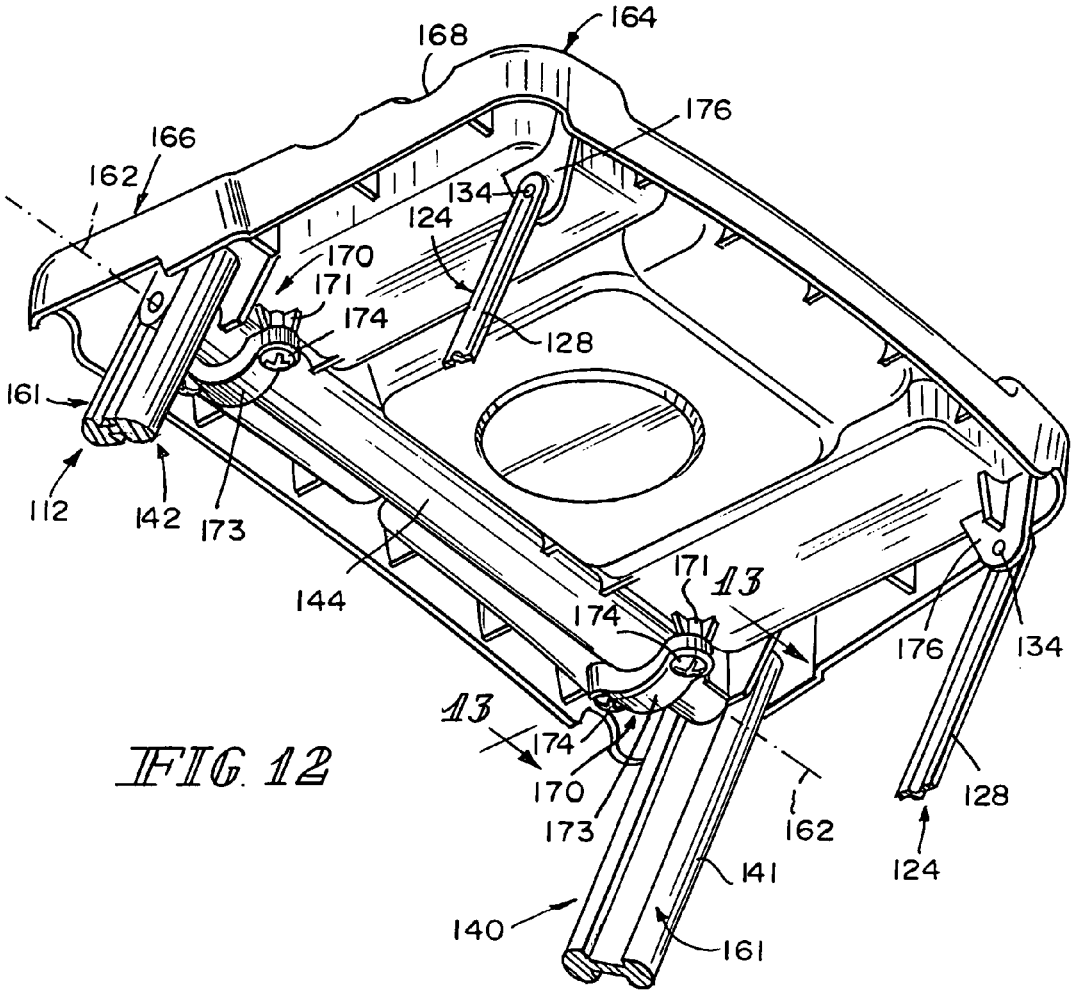
FIG. 12 is a perspective view, with portions broken away, showing the tray of FIG. 7 coupled to a cross member included in the front leg unit for pivotable movement about a horizontal axis to the stored position shown, for example, in FIG. 10.

As suggested in FIGS. 7 and 12, front leg unit 112 comprises a left leg 140 having an upper end 141, a right leg 142 having an upper end 143, and a top cross member 144. Right leg 142 is arranged to lie in spaced-apart relation to left leg 140. Top cross member 144 interconnects upper ends 141, 143 of left and right legs 140, 142 as shown, for example, in FIG. 12. Each of left and right legs 140, 142 includes a lower end adapted to contact ground 11 underlying frame 113 and a mid-section 145 or 146 located between lower and upper ends thereof. In the illustrated embodiment, feet 147 are mounted on the lower ends of each of left and right legs 140, 142. In the illustrated embodiment, front leg unit is U-shaped as suggested in FIGS. 7 and 12.

As suggested in FIG. 7, rear leg unit 114 comprises a left leg 150 having an upper end 151, a right leg 152 having an upper end 153, a middle cross member 156 interconnecting middle portions of left and right legs 150, 152. A step-support cross member 158 interconnecting upper portions of left and right legs 150, 152 is also included in rear leg unit 114 as suggested in FIGS. 9 and 11.

Upper ends 151, 153 of left and right legs 150, 152 are coupled, respectively, to mid-sections 145, 146 of left and right legs 140, 142 of front leg unit 112 at pivot points 139 so that rear leg unit 114 is able to pivot relative to front leg unit 112 about a leg pivot axis extending through pivot points 139. Thus, rear leg unit 114 can pivot about that leg pivot axis 139 between an opened position away from left and right legs 140, 142 as shown, for example, in FIGS. 7 and 8 and a closed position alongside left and right legs 140, 142 as shown, for example, in FIG. 10. As shown in FIGS. 7 and 8, leg pivot points 139 are located above top step pivot points 136 and below top cross member 144.

Front leg unit 112 includes a lower section 160 (comprising lower portions of left and right legs 140, 142) and an upper section 161 (comprising upper portions of left and right legs 140, 142) as suggested in FIGS. 7 and 8. Lower section 160 is arranged to extend downwardly from leg pivot axis 139 and adapted to contact ground 11 underlying frame 113. Upper section 161 extends upwardly away from lower section 160. Steps 118, 120, 122 are coupled to lower section 160.

Utility tray 116 is mounted on a distal portion of upper section 161 of front leg unit 112 for pivotable movement about a tray pivot axis 162 as suggested in FIGS. 7, 8, 12, and 13. In the illustrated embodiment, top cross member 144 is configured to define that distal portion of upper section 161.

Tray pivot controller 124 is configured to control pivoting movement of tray 116 relative to front leg unit 112 about tray pivot axis 162 during folding and unfolding of step stool 110. Each tray-mover link 128 is pivotably coupled to tray 116 at an upper link pivot axis intersecting pivot points 134 and to top step 118 at a lower link pivot axis intersecting pivot points 131. Tray-mover links 128 are configured to maintain tray 116 in substantially parallel relation to top step 118 during movement of rear leg unit 114 between the opened and closed positions as suggested in FIGS. 8 and 9.

As suggested in FIG. 8, tray 116 includes a shelf portion 164 and an overhang portion 166. Shelf portion 164 is pivotably coupled to top cross member 144 and to each tray-mover link 128. Top cross member 144 of U-shaped front leg unit 112 is arranged to lie above leg pivot axis 139 and below upper link pivot axis 134 upon movement of rear leg unit 112 to the closed position.

Figure 9:
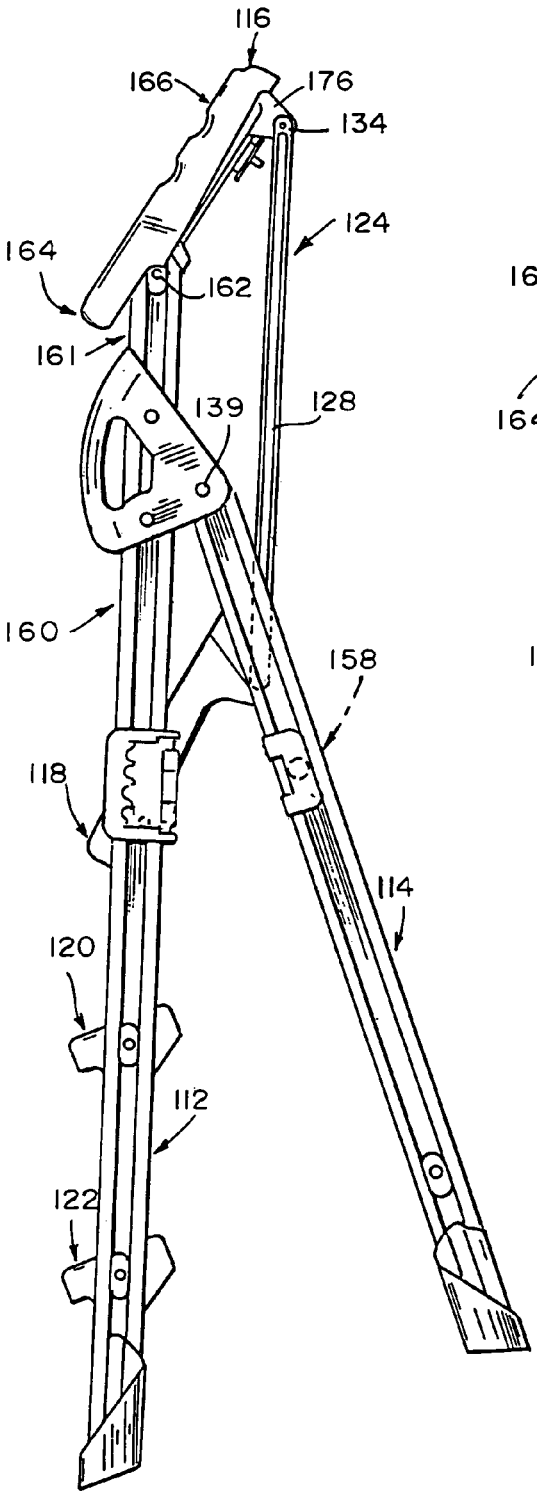
FIG. 9 is a side elevation view showing the step stool of FIG. 7 in a partly closed position and showing pivoting movement of the tray about the top end of the front leg unit in response to movement of the tray pivot controller during pivoting movement of the rear leg unit toward the front leg unit.

Shelf portion 164 of tray 116 is arranged to extend in a first direction from tray pivot axis 162 toward upper link pivot axis 134 and remain in substantially parallel relation to top step 118 during movement of rear leg unit 114 between the opened and closed positions. In the illustrated embodiment, as shown in FIGS. 8 and 9, shelf portion 164 of tray 116, a portion of tray-mover link 128 extending between pivot points 131, 134, top step 118, and upper section 161 of right leg 142 of front leg unit 112 cooperate to define a parallelogram-shaped linkage having pivoting joints at the "intersection" of each "link" in the linkage.

Overhang portion 166 of tray 116 is arranged to extend away from shelf portion 164 in a second direction opposite to the first direction to overlie leg pivot axis 139 as suggested, for example, in FIG. 8. Overhang portion 66 is arranged to extend along and in side-by-side relation to left and right legs 140, 142 of U-shaped front leg unit 112 upon movement of rear leg unit 114 to the closed position as suggested in FIG. 10.

Figure 13:
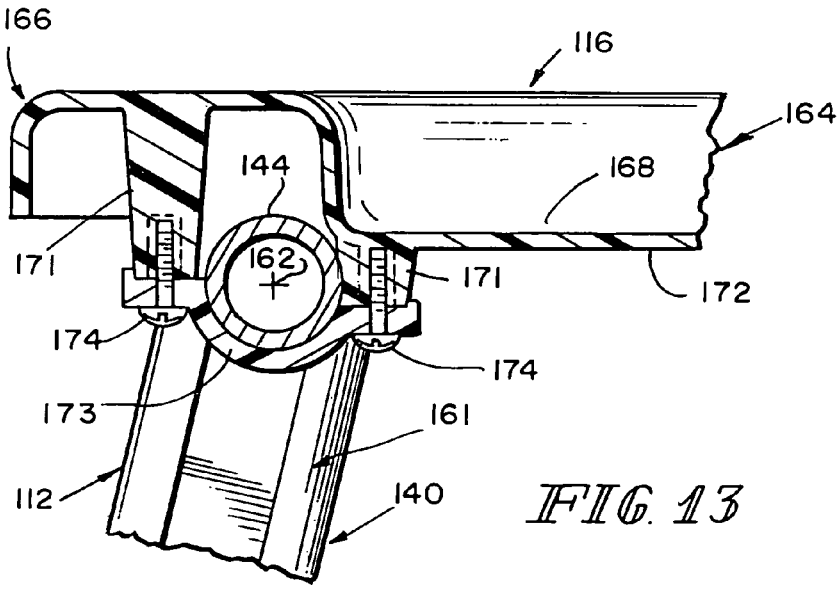
FIG. 13 is a sectional view taken along lines 13—13 of FIG. 12.

As suggested in FIGS. 12 and 13, shelf portion 164 includes a top shelf surface 168 and a pair of tray retainers 170 coupled to top cross member 144. Tray retainers 170 cooperate to define means for supporting tray 116 for rotation about tray pivot axis 162 during folding and unfolding of step stool 110.

Each tray retainer 170 includes fixed portions 171 coupled to an underside 172 of top shelf surface 168 and arranged to engage top cross member 144. Each tray retainer 170 also includes a movable clamp portion 173 arranged to engage top cross member 144. Fasteners 174 are included in each tray retainer 170 and arranged to retain clamp portion 173 in a selected position relative to a companion fixed portion to allow rotary movement of top cross member 144 in a space between fixed and clamp portions during pivoting movement of tray 116 relative to front leg unit 112 about tray pivot axis 162.

Figure 10:
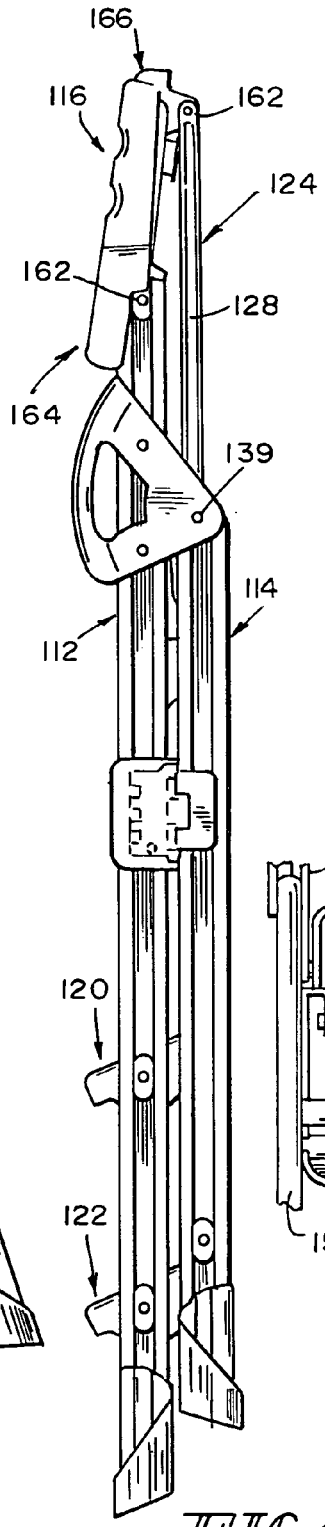
FIG. 10 is a side elevation view showing the step stool of FIG. 7 in a closed position.

Shelf portion 164 further includes a pair of pivot mounts 176 located below top shelf surface 168 as shown, for example, in FIGS. 7 and 12. Each pivot mount 176 is pivotably coupled to a companion tray-mover link 128 at upper link pivot axis 134 as shown best in FIG. 12. As shown in FIG. 10, pivot mount 176 is arranged to lie in spaced-apart relation to leg pivot axis 139 to locate top cross member 144 of U-shaped front leg unit 112 therebetween upon movement of rear leg unit 114 to the closed position.

Second step 120 is arranged to lie under top step 118 and between left and right legs 140, 142 of front leg unit 112 as suggested in FIG. 7. Third step 122 is arranged to lie under second step 120 and between left and right legs 140, 142 of front leg unit 112 as suggested in FIG. 7.

Tray pivot controller 124 is coupled to top step 118, rear leg unit 114, and tray 116 to cause pivotable movement between front and rear leg units 112, 114 and pivotable movement of tray 116 on top cross member 144 upon pivotable movement of top step 118 relative to legs 140, 142 of front leg unit 112 as suggested in FIGS. 8–10. In the illustrated embodiment, each tray-mover link 128 is a straight, elongated member that is arranged to lie in and remain in parallel relation to a companion one of the left and right legs 140, 142 of front leg unit 112 during movement of rear leg unit 114 between the opened and closed positions.

The invention claimed is:

1. A step stool comprising a frame including a U-shaped front leg unit comprising a left leg having an upper end, a right leg having an upper end and lying in spaced-apart relation to the left leg, and a top cross member interconnecting the upper ends of the left and right legs, each of the left and right legs including a lower end adapted to contact ground underlying the frame and a mid-section located between the lower and upper ends thereof, a top step arranged to lie between the left and right legs and coupled to the mid-sections of the left and right legs of the U-shaped front leg unit at a top step pivot point on each of the left and right legs for pivotable movement about a first step pivot axis, the frame further including a rear leg unit coupled to the mid-sections of the left and right legs at leg pivot points located above the top step pivot points and below the top cross member for pivotable movement about a leg pivot axis relative to the front leg unit between an opened position away from the left and right legs and a closed position alongside the left and right legs, a tray mounted for pivotable movement on the top cross member about a tray pivot axis, and a tray pivot controller comprising a tray-mover link pivotably coupled to the tray at an upper link pivot axis and to the top step at a first lower link pivot axis and configured to maintain the tray in substantially parallel relation to the top step during movement of the rear leg unit between the opened and closed positions.

2. The step stool of claim 1, wherein the tray includes a shelf portion pivotably coupled to the top cross member and to the tray-mover link and arranged to extend in a first direction from the tray pivot axis toward the upper link pivot axis and remain in substantially parallel relation to the top step during movement of the rear leg unit between the opened and closed positions and the tray further includes an overhang portion appended to the shelf portion and arranged to extend away from the shelf portion in a second direction opposite to the first direction to overlie the leg pivot axis.

3. The step stool of claim 2, wherein the overhang portion is arranged to extend along and in side-by-side relation to the left and right legs of the U-shaped front leg unit upon movement of the rear leg unit to the closed position.

4. The step stool of claim 1, further comprising a second step arranged to lie under the top step and between the left and right legs and coupled to the mid-sections of the left and right legs at a second step pivot point on each of the left and right legs for pivotable movement about a second step pivot axis and the tray-mover link is also pivotably coupled to the second step at a second lower link pivot axis.

5. The step stool of claim 4, wherein the tray-mover link is a straight, elongated member that is arranged to lie in and remain in parallel relation to a companion one of the left and right legs during movement of the rear leg unit between the opened and closed positions.

6. The step stool of claim 4, further comprising a third step arranged to lie under the second step and between the left and right legs and coupled to the mid-sections of the left and right legs at a third step pivot point on each of the left and right legs for pivotable movement about a third step pivot axis and the tray-mover link is also pivotably coupled to the third step at a third lower link pivot axis.

7. The step stool of claim 6, wherein the tray-mover link is a straight, elongated member that is arranged to lie in and remain in parallel relation to a companion one of the left and right legs during movement of the rear leg unit between the opened and closed positions.

8. The step stool of claim 4, wherein the tray pivot controller further includes a step-folder link pivotably coupled at one end to the rear leg unit and at an opposite end to the second step and the tray-mover link at the second lower link pivot axis.

9. The step of claim 1, wherein the leg unit includes a left leg pivotably coupled to the left leg of the U-shaped front leg unit, a right leg pivotably coupled to the right leg of the U-shaped front leg unit, a right leg pivotably coupled to and right legs of the rear leg unit and arranged to support the top step upon movement of the rear leg unit to the opened position, and wherein the tray pivot controller further includes a step-folder link pivotably coupled at one end to the step-support cross member and at an opposite end to the top step.

10. A step stool comprising a frame including a U-shaped front leg unit comprising a left leg having an upper end, a right leg having an upper end and lying in spaced-apart relation to the left leg, and a top cross member interconnecting the upper ends of the left and right legs, each of the left and right legs including a lower end adapted to contact ground underlying the frame and a mid-section located between the lower and upper ends thereof, a top step arranged to lie between the left and right legs and coupled to the mid-sections of the left and right legs of the U-shaped front leg unit at a top step pivot point on each of the left and right legs for pivotable movement about a first step pivot axis, the frame further including a rear leg unit coupled to the mid-sections of the left and right legs at leg pivot points located above the top step pivot points and below the top cross member for pivotable movement about a leg pivot axis relative to the front leg unit between an opened position away from the left and right legs and a closed position alongside the left and right legs, a tray mounted for pivotable movement on the top cross member about a tray pivot axis, and a tray pivot controller comprising a tray-mover link pivotably coupled to the tray at an upper link pivot axis and to the top step at a first lower link pivot axis and configured to maintain the tray in substantially parallel relation to the top step during movement of the rear leg unit between the opened and closed positions, wherein the tray includes a shelf portion pivotably coupled to the top cross member and to the first tray-mover link and arranged to extend in a first direction from the tray pivot axis toward the upper link pivot axis and remain in substantially parallel relation to the top step during movement of the rear leg unit between the opened and closed positions and the tray further includes an overhang portion appended to the shelf portion and arranged to extend away from the shelf portion in a second direction opposite to the first direction to overlie the leg pivot axis, wherein the top cross member of the U-shaped front leg unit is arranged to lie above the leg pivot axis and below the upper link pivot axis upon movement of the rear leg unit to the closed position.

11. A step stool comprising a frame including a U-shaped front leg unit comprising a left leg having an upper end, a right leg having an upper end and lying in spaced-apart relation to the left leg, and a top cross member interconnecting the upper ends of the left and right legs, each of the left and right legs including a lower end adapted to contact ground underlying the frame and a mid-section located between the lower and upper ends thereof, a top step arranged to lie between the left and right legs and coupled to the mid-sections of the left and right legs of the U-shaped front leg unit at a top step pivot point on each of the left and right legs for pivotable movement about a first step pivot axis, the frame further including a rear leg unit coupled to the mid-sections of the left and right legs at leg pivot points located above the top step pivot points and below the top cross member for pivotable movement about a leg pivot axis relative to the front leg unit between an opened position away from the left and right legs and a closed position alongside the left and right legs, a tray mounted for pivotable movement on the top cross member about a tray pivot axis, and a tray pivot controller comprising a tray-mover link pivotably coupled to the tray at an upper link pivot axis and to the top step at a first lower link pivot axis and configured to maintain the tray in substantially parallel relation to the top step during movement of the rear leg unit between the opened and closed positions, wherein the tray includes a shelf portion pivotably coupled to the top cross member and to the first tray-mover link and arranged to extend in a first direction from the tray pivot axis toward the upper link pivot axis and remain in substantially parallel relation to the top step during movement of the rear leg unit between the opened and closed positions and the tray further includes an overhang portion appended to the shelf portion and arranged to extend away from the shelf portion in a second direction opposite to the first direction to overlie the leg pivot axis, wherein the shelf portion includes a top shelf surface and a tray retainer coupled to the top cross member and the tray retainer includes a fixed portion coupled to the underside of the top shelf surface and arranged to engage the top cross member, a movable clamp portion arranged to engage the top cross member, and a fastener arranged to retain the clamp portion in a selected position relative to the fixed portion to allow rotary movement of the top cross member in a space between the fixed and clamp portions during pivoting movement of the tray relative to the front leg unit about the tray pivot axis.

12. The step stool of claim 11, wherein the shelf portion further includes a pivot mount located below the top shelf surface and pivotably coupled to the tray-mover link at the upper link pivot axis and the pivot mount is arranged to lie in spaced-apart relation to the leg pivot axis to locate the top cross member of the U-shaped front leg unit therebetween upon movement of the rear leg unit to the closed position.

13. A step stool comprising a frame including a U-shaped front leg unit comprising a left leg having an upper end, a right leg having an upper end and lying in spaced-apart relation to the left leg, and a top cross member interconnecting the upper ends of the left and right legs, each of the left and right legs including a lower end adapted to contact ground underlying the frame and a mid-section located between the lower and upper ends thereof, a top step arranged to lie between the left and right legs and coupled to the mid-sections of the left and right legs of the U-shaped front leg unit at a top step pivot point on each of the left and right legs for pivotable movement about a first step pivot axis, the frame further including a rear leg unit coupled to the mid-sections of the left and right legs at leg pivot points located above the top step pivot points and below the top cross member for pivotable movement about a leg pivot axis relative to the front leg unit between an opened position away from the left and right legs and a closed position alongside the left and right legs, a tray mounted for pivotable movement on the top cross member about a tray pivot axis, and a tray pivot controller comprising a tray-mover link pivotably coupled to the tray at an upper link pivot axis and to the top step at a first lower link pivot axis and configured to maintain the tray in substantially parallel relation to the top step during movement of the rear leg unit between the opened and closed positions, wherein the top cross member of the U-shaped front leg unit is arranged to lie above the leg pivot axis and below the upper link pivot axis upon movement of the rear leg unit to the closed position.

14. A step stool comprising a frame including a U-shaped front leg unit comprising a left leg having an upper end, a right leg having an upper end and lying in spaced-apart relation to the left leg, and a top cross member interconnecting the upper ends of the left and right legs, each of the left and right legs including a lower end adapted to contact ground underlying the frame and a mid-section located between the lower and upper ends thereof, a top step arranged to lie between the left and right legs and coupled to the mid-sections of the left and right legs of the U-shaped front leg unit at a top step pivot point on each of the left and right legs for pivotable movement about a first step pivot axis, the frame further including a rear leg unit coupled to the mid-sections of the left and right legs at leg pivot points located above the top step pivot points and below the top cross member for pivotable movement about a leg pivot axis relative to the front leg unit between an opened position away from the left and right legs and a closed position alongside the left and right legs, a tray mounted for pivotable movement on the top cross member about a tray pivot axis, and a tray pivot controller comprising a tray-mover link pivotably coupled to the tray at an upper link pivot axis and to the top step at a first lower link pivot axis and configured to maintain the tray in substantially parallel relation to the top step during movement of the rear leg unit between the opened and closed positions, wherein the tray includes a top shelf surface and a tray retainer coupled to the top cross member and the tray retainer includes a fixed portion coupled to the underside of the top shelf surface and arranged to engage the top cross member, a movable clamp portion arranged to engage the top cross member, and a fastener arranged to retain the clamp portion in a selected position relative to the fixed portion to allow rotary movement of the top cross member in a space between the fixed and clamp portion during pivoting movement of the tray relative to the front leg unit about the tray pivot axis.

15. The step stool of claim 14, wherein the shelf portion further includes a pivot mount located below the top shelf surface and pivotably coupled to the tray-mover link at the upper link pivot axis and the pivot mount is arranged to lie in spaced-apart relation to the leg pivot axis to locate the top cross member of the U-shaped front leg unit therebetween upon movement of the rear leg to the closed position.

* * * * *